US005622094A

United States Patent [19]

Rexroad

[11] Patent Number: 5,622,094

[45] Date of Patent: Apr. 22, 1997

[54] HOLLOW BRAID NET AND METHOD MAKING

[76] Inventor: John Rexroad, 12 Jackson Rd., Killingworth, Conn. 06419

[21] Appl. No.: 414,185

[22] Filed: Mar. 31, 1995

[51] Int. Cl.[6] ..... D04C 1/00

[52] U.S. Cl. ..... 87/12; 87/9; 87/13; 87/53

[58] Field of Search ..... 87/5, 12, 13, 53, 87/62, 9

[56] References Cited

U.S. PATENT DOCUMENTS

| | | | |
|---|---|---|---|
| 1,700,192 | 1/1929 | Appleyard | 87/12 |
| 2,194,865 | 3/1940 | Mizugoshi | 87/12 |
| 3,170,611 | 2/1965 | Gullen | 87/12 X |
| 4,000,344 | 12/1976 | Dilbey | 87/12 X |
| 4,257,309 | 3/1981 | Dunahoo | 87/12 |
| 4,651,620 | 3/1987 | Lyons | 87/12 |
| 5,328,310 | 7/1994 | Lockney | 87/12 X |

FOREIGN PATENT DOCUMENTS

| | | | |
|---|---|---|---|
| 879729 | 3/1943 | France | 87/12 |

*Primary Examiner*—William Strysewski
*Attorney, Agent, or Firm*—Perman & Green

[57] ABSTRACT

A net comprises a border member defined by at least a first border section and a second border section each extending generally orthogonally to one another and having a plurality of weft members each connected to one of the first and second border sections and being disposed in a first given direction. The net includes a plurality of warp members each connected to the other of the first and second border sections and being disposed in a second given direction generally oriented orthoganally to the first given direction. The weft and warp members being crossed with one another in a single common plane and in a manner which causes the members to be locked against relative axial and twisting movement. Each of said weft and warp members being a hollow braid member capable of being transversely pierced by the other such member.

23 Claims, 6 Drawing Sheets

HOLLOW BRAID NET AND METHOD MAKING

CROSS-REFERENCE TO RELATED APPLICATIONS

The present invention relates to copending U.S. application Ser. No. 08/153,623 entitled IMPROVED CLIMBING NET filed in the name of Rexroad, et al, on Nov. 17, 1993 and further relates to copending U.S. application Ser. No. 08/557,851 filled on Nov. 14, 1995 in the name of John Rexroad and entitled NET WITH FLATTENED SURFACE MEMBERS CONNECTED AT SEWN INTERSECTIONS.

BACKGROUND OF THE INVENTION

The present invention relates to a net, and more particularly to an improvement in net construction wherein the members of the net are constructed from a material which lends itself to interconnection with like members to create a highly stable lattice which constitutes the net structure.

Conventional net construction involves rope or cordage which is connected at nodes to create a lattice of intersecting members constituting the matrix structure of the net. In such conventional net constructions, the application for use as climbing nets is problematic in that the intersection of vertically and horizontally disposed lengths of cordage are not connected such that when a force is applied to a horizontal cordage length, the resulting downward force is directed along vertical lines of action. Instead, such a downwardly-applied force is distributed both vertically and laterally through the net, thereby making the net an unstable structure for the purpose of, for example, supporting an individual. Also, where a net is to be used for climbing, it is desirable to construct a net from a material which is non-abrasive to the touch of the human hand. This is important in the application of the net where it is used for amusement purposes for children. In such cases, it is desirable to have a material which will not cause abrasions when, for example, gripped or rubbed by a child. Moreover, even where nonabrasive materials are used in net construction, such as, multifilament polypropylene or propylene ethylene copolymer, the nets are not without problems. Specifically, with using such material, the ends of the lengths of cordage nevertheless need to be heated in order to melt the plastic and prevent unraveling of the multifilaments. These heated end portions tend to be sharp and leave hard knobs and defeat the nonabrasive character of the overall netting, in that the heated ends of hardened plastic material have the tendency to scrap or scratch an individual.

Nets made from conventional plastic material monofilaments present even worse problems than those discussed above. Such monofilaments are also problematic in that when exposed to ultraviolet light, these elements often become brittle, and severe causing barb-like projections to extend transversely from the cordage. Needless to say, such barb-like projections are undesirable, especially in the context where the intended use of the net is for climbing or personnel usage. Also, in the context of using a net in a recreational sense for children, it is often times desirable to make playing with the net more applicable by using cordage of different colors. Thus, it is desirable to use a netting material which is colorfast, and that will not permit the coloring pigment to be imparted onto a user when gripped or rubbed against. The need to provide netting which is differently colored also has its basis in industrial applications as well. For example, it is possible that netting used for safety and cargo load purposes requires color-coding in the event that it is used in a specific on-site application. Also, material which is used to construct conventional nets does not readily lend itself to being used with other materials which supplement and enhance the strength of the component members which make up the net.

Accordingly, it is an object of the present invention to provide a net construction which is capable of being readily assembled in lattice form and is assembled from a material which is nonabrasive and is constructed so as to not cause a user to be cut or scratched by using it.

It is still a further object of the invention to provide a net lattice of the type wherein the lattice is constructed of lengths of cord which create laterally stable matrix structure.

It is yet a further object of the invention to provide a net lattice of the type which is formed from material which is colorfast and is resistant to ultraviolet radiation.

Still a further object of the invention is to provide net lattice constructed from a type of material which is capable of being readily used with another material to supplement the strength of the members constituting the net structure.

SUMMARY OF THE INVENTION

The invention resides in an improved net construction and related method of making same wherein a net is comprised of a plurality of weft and warp members interconnected so as to be generally orthogonally disposed to one another so as to create a net lattice structure. The lattice is defined by the interconnection of weft and warp members which are crossed in a common plane and in such a manner as to be secured against relative axial and twisting movement. This securement is further achieved by providing the members as hollow members thereby allowing a one member to pierce through the other and in effect cause the other member to lock the one which pierces it.

DETAILED DESCRIPTION OF THE PREFERRED EMBODIMENTS

Figure 1:
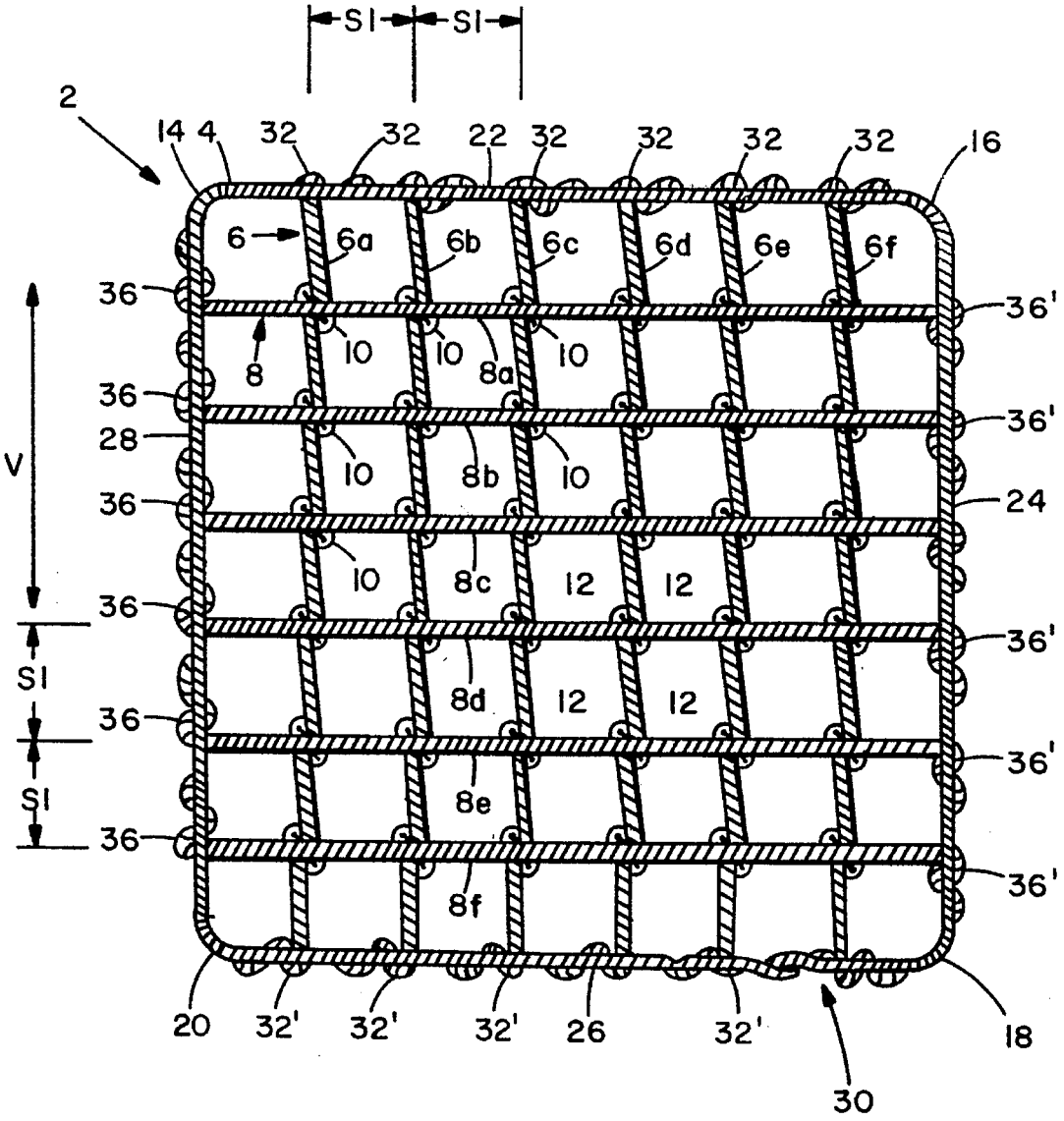
FIG. 1 is a plan view of the net lattice embodying the present invention.

FIG. 1 illustrates a net referenced generally as 2. The net is defined by a net lattice and is comprised of a border member 4 and a plurality of weft members 6,6 extending in one direction and a plurality of warp members 8,8 extending orthogonally to one another and interconnected with one another at nodes 10,10. The weft and warp members 6,6 and 8,8 interconnect with the border member 4 in a manner which will be discussed in greater detail later. The weft, warp and border members taken together more importantly create rows and columns of rope boxes 12,12 arranged in a matrix to generate the illustrated grid-like pattern shown in FIG. 1. The border member 4 encloses an area defining the lattice of the net 2. To better define this area for purposes of discussion, it should be seen that the border member can be defined by four corner points identified as 14, 16, 18, and 20, which, when taken consecutively in pairs, define a first border section 22, extending between points 14 and 16, a second border section 24, extending between points 16 and 18, a third border section 26, extending between points 18 and 20, and a fourth border section 28, which extends between points 20 and 14. The border member 4 is itself comprised of a single piece of cord spliced end to end at point 30 in a manner which will be discussed in greater detail with reference to the embodiments of FIGS. 7 and 8. For the moment, it should nevertheless be seen that the end-to-end splice, referenced generally at 30 in FIG. 1, is provided for the purpose of enclosing the lattice structure of the net with the border. The intersection of the warp and weft members may or may not occur at this point in the border depending on the type of the splice used. The lattice is defined by a series of rope boxes 12,12 which, in the illustrated embodiment, measure approximately 5- to 7-inches square, but this dimension is variable according to application.

Figure 2:
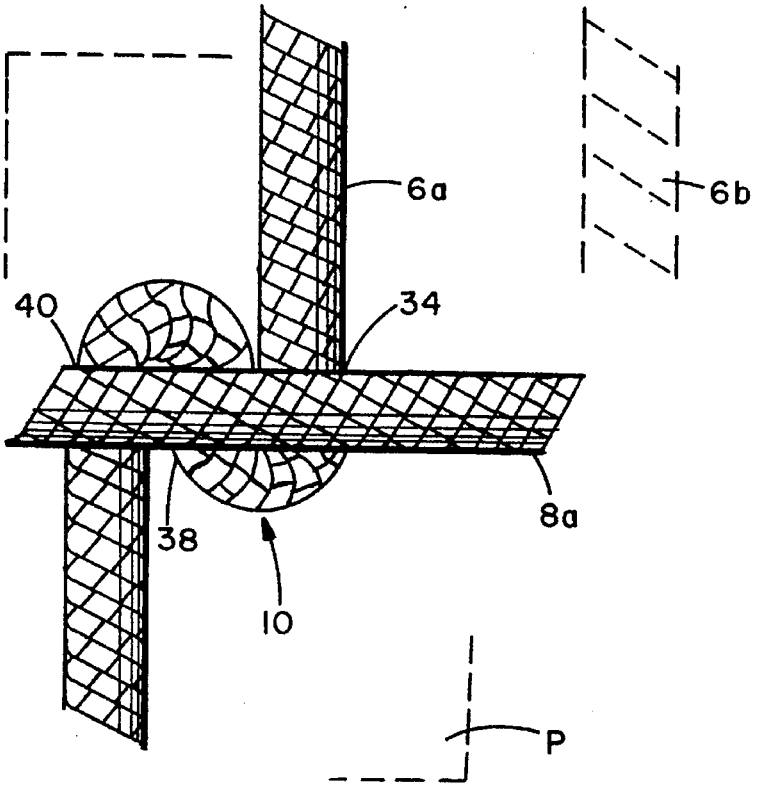
FIG. 2 is a partially fragmentary view illustrating he crossing structure between intercepting weft and warp members.

The lattice structure of FIG. 1 is constructed such that each of the rope boxes 12,12 is defined by the plurality of the weft members 6*a*, 6*b*, 6*c*, 6*d*, 6*e*, and 6*f* intersecting respectively with one of the warp members 8*a*, 8*b*, 8*c*, 8*d*, 8*e*, and 8*f* in such a way as to cause the warp members 8,8 to be sustained in a stable condition when loading is applied in the illustrated V direction. To this end, as illustrated in FIG. 2, the node 10 is shown as the intersection between weft member 6*a* and warp member 8*a* and this node is identical to each and every one of the other nodes 10,10 which make up the lattice of the net 2.

Figure 3:
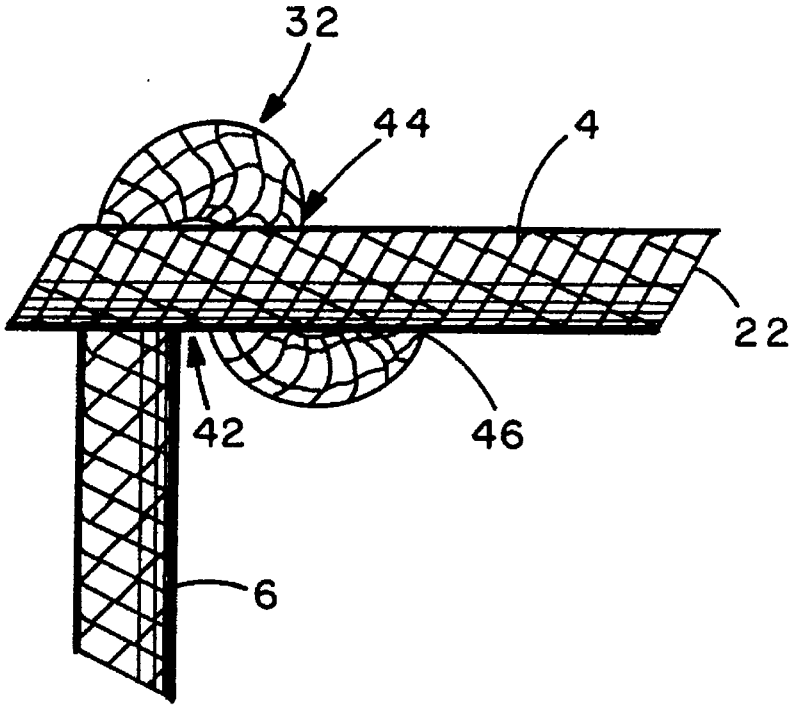
FIG. 3 is a partially fragmented view of a weft or warp member spliced and tucked into a border members.

It is a feature of the invention that the material from which the border member, the weft and warp members are selected, is a material which lends itself to being readily pierced and locked when crossed in a manner disclosed with regard to one aspect of the invention. Further, the selected material is such that it lends itself to receiving in its hollow confines, the free end 48 of the weft or warp member in the instance where it is desired to tuck the end 48 as in the case of FIG. 3, or alternatively to allow the free end of the weft or warp members to traverse completely through the border member as in the case of the splice shown in FIG. 5. To these ends, the material making up the net is a hollow braid material and is hence formed from a polypropylene or DACRON (trademark for polyester) rope having a multi-filament construction. In the preferred embodiment, the material is a 24 carrier polypropylene multi-filament hollow braid which is colorfast flat black. Notwithstanding, it should be understood that cord material with numerously different carrier numbers may be used in the practice of the invention. The construction of the particular braid used is well adapted to bite down on a cord which is inserted transversely into its hollow confine when tension is applied along its axial extent. The nodes 10,10 occur successively along each one of the warp members 8,8, and that along each warp member 8,8, the number of nodes existing along that warp member are constituted by the number of weft members 6,6 which intersect it. This is because the net 2 is formed by progressively adding warp members 8,8 in a downward progression taken from the first border section 22 towards the third border section 26 to create the illustrated net structure in the following manner.

The method of making the net 2 is effected by the border member 4 being first laid out so as to dispose the first border section 22 and opposed second and fourth border sections 24 and 28 in a U-shaped manner leaving the third border section 22 unconnected and open. Following this, each of the weft members 6*a*–6*f* is connected to the first border section 22 at points 32,32 in a manner which will hereinafter be described in detail later with respect to FIGS. 3–6. Then, the left-most end of the topmost warp member 8*a* is secured to the border member 4 at point 36 in a manner which is similar to the connection points 32,32. Once the left end of the weft member 8*a* is secured in this manner, the left-most one of the weft members, in this case member 6*a*, is caused to cross and lock with the warp member in the following manner. The weft member pierces the warp member 8*a* through at point 34 illustrated in FIG. 2. The warp member 6*a* is then turned 180° back into the weft member 8*a* and is caused to pierce it again at a point 38 which is laterally offset from the entry point 34. Thereafter, the weft member 6*a* is again caused to turn 180° back into the warp member 8*a* at point 40 which is laterally offset from the second piercing point 38 whereupon the weft member exits the warp member 8*a* and its entire length is pulled through the warp member so as to be readied for crossing the next warp member 8*b* in a manner identical to that discussed above. The next right-most one of the weft members, in this case, member 6*b*, is crossed with the warp member 8*a* in the manner discussed with respect to weft member 6*a*, and this process continues in succession until each of the remaining weft members 6*b*–6*f* crosses and locks with the warp member 8*a* in the same manner.

The interconnections which make up the lattice of the net create a highly stable structure, not only in terms of stability taken along line V, but also in terms of preventing twisting of the weft, warp and border members once interconnected in the net lattice and further serve to secure the weft members against axial movement relative to the involved warp member. The interconnection between the members 6 and 8, as illustrated in FIG. 2, occurs throughout the net lattice in a common plane CP so as to cause the orientation of the weft and warp members to be locked against twisting. This is important because the hollow braid material from which the net is constructed, has a generally flat profile as shown by region R in FIG. 7 when loads are applied to the material, and hence it is desirable to maintain the same orientation of all braids throughout the lattice.

Once the last of the weft members, in this case, member 6*f*, is crossed with the right end of the warp member 8*a*, then the warp member 8a is itself secured to the border around the second border section 24 at the securement point 36' in manner which will be discussed in greater detail with respect to FIGS. 3–6. Following this, the next warp member, in this case, member 8b, is secured to the border member 4 at point 36 and is thereafter caused to be crossed with each of the weft members 6a–6f progressing from the ordered weft members taken from the left and moving to the right. This process continues for each of the remaining warp members 8c–8f until the lattice structure is completed. As illustrated, each of the rope boxes 12,12 of the lattice is defined by one of the connection points from each set of points, 32,32 and 36,36, which connection points each having spacings indicated by dimension S1,S1. The dimension S1,S1 is selected for a given application of the net, but may vary according to use. Thus, the spacing between the points 36,36 can vary relative to the spacing between points 32,32 in order to vary the shape of the boxes 12,12 to in fact, for example, make them rectangular if so desired. Once the crossing of each of the warp members 8,8 is complete, the remaining free ends of the weft members 6,6 are then secured to the border member 4 along the third border section 26 at points 32', 32'. This is done by first extending the third border section 26 between corner points 20 and 18 so as to cause right angle turns of the border member at these points and thereby cause the free ends of the border member to be directed towards each other in a straight-line path to thereafter allow the connections 32',32' to be effected along this path. As will be discussed in greater detail later with respect to the embodiment of FIG. 7, one of the weft or warp members may be used to complete the end to end splice 30, and thus the connections referenced at 32',32' should be deemed to also include the end to end connection 30.

Figure 5:
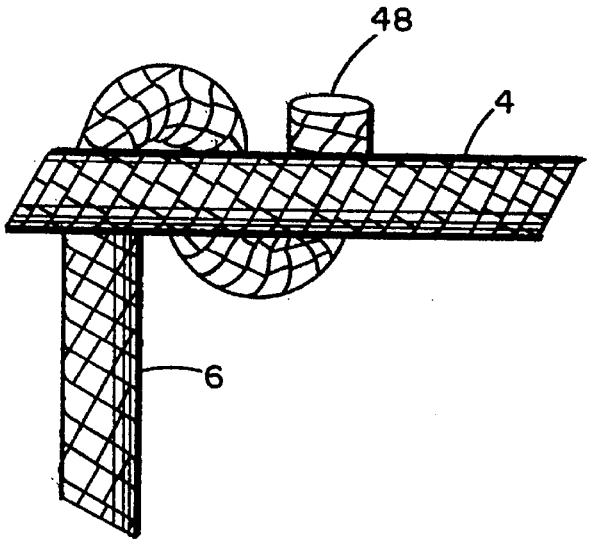
FIG. 5 is a partially fragmented view of a third embodiment of the splice shown in FIG. 3 wherein the weft or warp member is crossed with the border member with its end out.

Turning now to FIGS. 3–6, it should be seen that each of the border splices shown in these figures is a connection of either a weft or a warp member connected to the border member 4 at one of points 32,32' or 36,36'. In the illustrated example of FIG. 3, the connection shown therein is at the connection point 32 which means that it is the connection between the first border section 22 and one of the weft members 6,6. As illustrated, the free end of the weft member 6 is caused to pierce and pass through the border member 4 transversely of its length at point 42 and thereafter secondarily pierce through the border member traversely of its length at 44, a point offset from point 42, and further thereafter be turned 180° into the border member at a point 46 which is further laterally offset from each of the points 42 and 44. The free end of the weft or warp members is then tucked into the hollow confine of the receiving warp member. Alternatively, as illustrated in FIG. 5, the free end 48 of the member 6 ultimately transverses the border member 4 on its third pass through the border member 4, and may alternatively be caused to completely exit from the border member rather than being tucked within its hollow confine.

Figure 4:
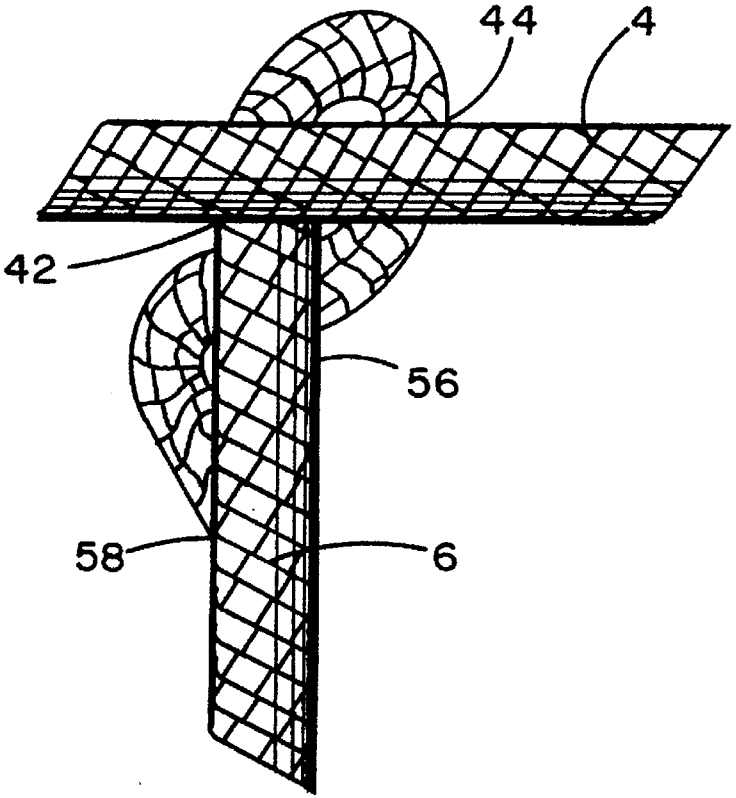
FIG. 4 is a partially fragmented view of a second embodiment of the splice of FIG. 3 wherein the weft or warp member is crossed with the border and tucks back with itself.
Figure 6:
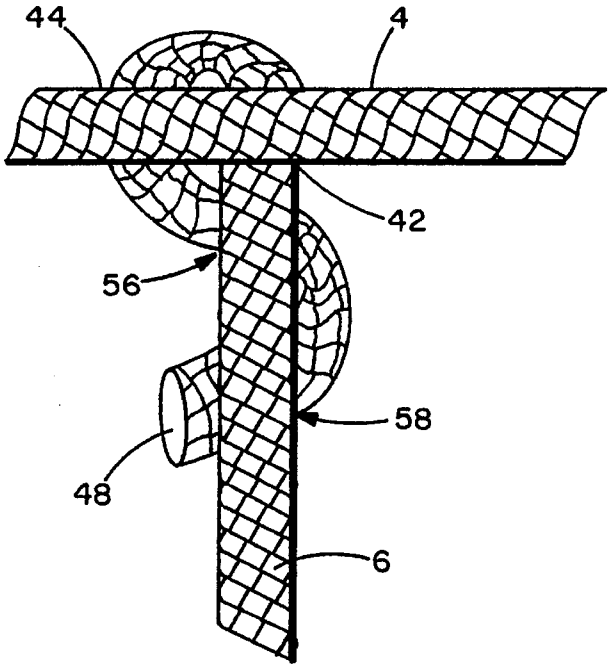
FIG. 6 is a partially fragmented view of a fourth embodiment of the splice of FIG. 3 wherein the weft or warp member is crossed with the border member and is returned back to itself with its end out.

As illustrated in FIGS. 4 and 6, the weft or warp members, either of which is represented by reference numeral 6 in these figures, may be spliced with the border member 4 by causing either to pierce the transverse extent of the border member 4 in a manner discussed previously above with reference to points 42 and 44. However, in the embodiments of FIGS. 4 and 6, the free end 48 of the member 6 is not terminated in whole or in part within the border member 4 as in the case of the splice shown in FIGS. 3 and 5. Rather, the free end 48 is returned back to the member 6 after piercing through the border member at point 44. That is, the member 6 after transversely piercing through the border member 4 at the point 44, is caused to pierce itself at point 56 proximate the border member 4 and be passed transversely through itself and thereafter be caused to turn 180° and again pierce the member 6 at point 58 laterally offset from the piercing point 56. Depending on the particular application which is involved, the free end 48 of the member 6 as illustrated in FIG. 6 may extend completely through the elongate extent of the member 6 and remain in an outwardly disposed condition, or be tucked within the hollow confines of the member as illustrated in FIG. 4.

Figure 7:
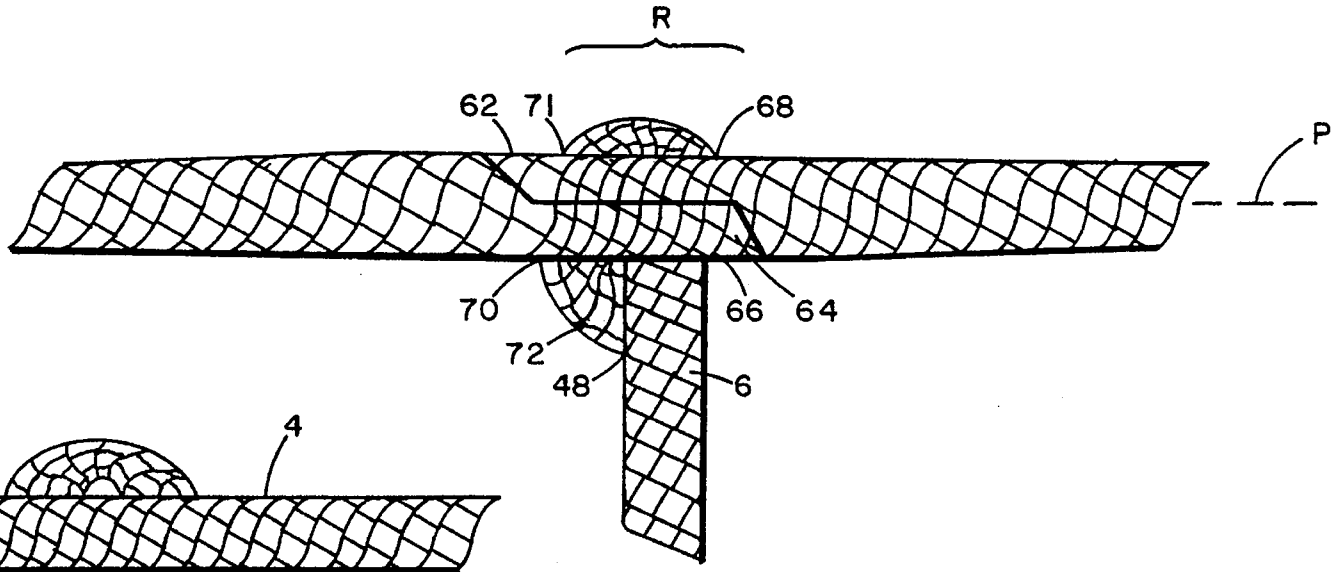
FIG. 7 is a partially fragmentary view illustrating a parallel splice between border members arranged end to end with one another with the ends left in a warp or weft member locking connection.

Referring now to FIG. 7, and to the first embodiment of an end-to-end border splice 30 which may be used to effect connection of the free ends of the border member 4 with either of the weft or warp members 6 or 8, it should be seen that the border member 4, in the illustrated example of FIG. 7, is defined by free end portions 62 and 64 which are connected through the intermediary of one of the weft or warp members 6 and 8. As illustrated, the convention of the hollow braid permits it to collapse on itself in a block-like manner, and this characteristic is used in the region illustrated by the reference region R in FIG. 7, so as to allow overlapping such lengths of the member 4 to be overlaid on each other in a planar manner along the indicated horizontal plane P. With the free end portions 62 and 64 of the member 4 arranged in this manner, the member 6 is cause to pierce through the stacked free-end portions by first piercing member position 64 at point 66 and then subsequently piercing through the free-end portion 62 at the plane P, and thereafter exiting the overlapped region at point 68. The member 6 is then cause to turn 180° and then repierce the overlapped region R of the end portions at 71 and thereafter exit at point 70 whereupon the free-end 48 of the member 6 is cause to pierce itself at 72 in an end-tuck condition as discussed with reference to FIGS. 3 and 4 above.

Figure 8:
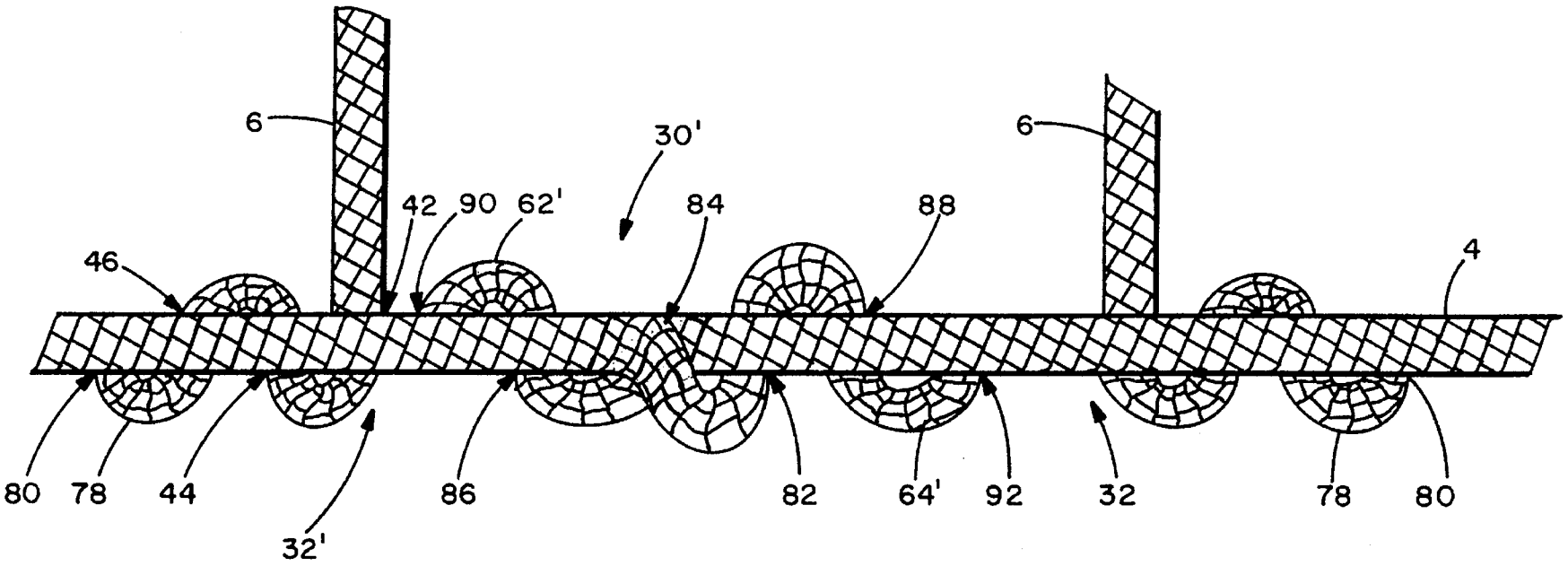
FIG. 8 is a partially fragmentary view of alternative embodiment to the parallel splice shown in FIG. 7 showing a serpentine interconnection.

In the illustrated example of FIG. 8, a second embodiment of the end splice 30 is shown. The splice here indicated generally as 30' differs from the splice of FIG. 7 in that it is effected without using either a weft or warf member connection as is the case in the embodiment of FIG. 7. The members 6,6 again may constitute either a weft or warf member which is caused to be connected to the border member at either locations 32,32', or 36,36', respectively. The illustrated connection is one made along the third border section 26 at connection points 32',32'. As illustrated, the weft members 6,6 normally would splice into the border member 4 and be crossed with it so as to extend in the same direction for purposes of uniformity. However, as illustrated in FIG. 8, since the border splice 30' is located between juxtaposed weft members 6,6, the free ends of these members are turned oppositely of one another so as to stand clear of the end-to-end splice connection 30', which is interposed therebetween. Notwithstanding, it should be understood that any of the border splice connections which are shown in FIGS. 3–6 are suitable for effecting the connections 32', 32'. In the illustrated example of FIG. 8, the splice is essentially identical to that shown in FIG. 3, with the exception that the crossed weft or warf member 6 includes an additional 180 degree turn 78 which pierces the border member 4 at the entrance point 80, and is thereafter tucked within the hollow confines of the border member to prevent its unravelling. Turning now to the specifics of the border member end-to-end splice 30', it should be seen that the splice is made between a border first free end portion 62' and a border second free end portion 64' in the following manner. The first the free end portion 62' is caused to pierce and pass transversely through the second free end portion 64' at point 84. Similarly, at a point axially offset to the crossing point 84, the second free end portion 64' is caused to pierce the first free end portion 62' at point 82. Thereafter, each of the first and second free end portions 62' and 64' are then caused to cross the border member 4 in a serpentine manner transversely completely piercing through the remaining length of the border member 4 at points 86 and 88, respectively. In the illustrated example, the leading edge of each of the first and second free end portions 62' and 64' of the border member 4 is caused to be tucked at points 90 and 92, respectively, within the border member 4 in a manner similar to that discussed with reference to the splices shown in FIGS. 3 and 7. The particular serpentine configuration of the end splice 30' provides a highly effective structure for connecting the free ends of the border members against axial unraveling given the particular convention of the hollow braids to bite down on the member which is crossed transversely through it.

Figure 10:
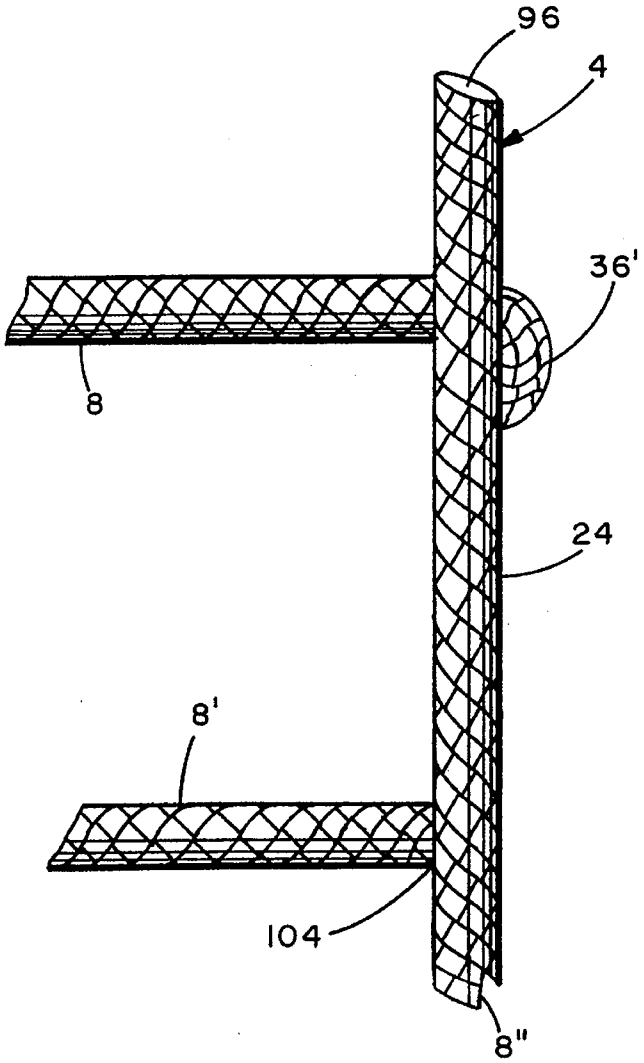
FIG. 10 is a partially fragmentary view of a weft or warp to border internal splice with a tuck and the end of the weft received in the border.
Figure 9:
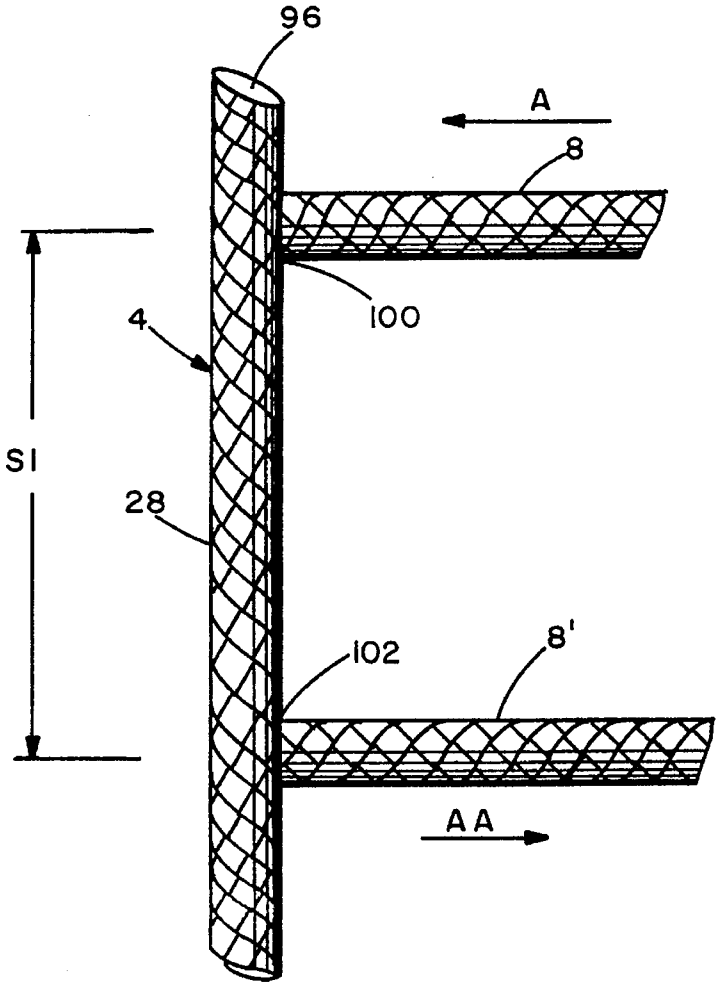
FIG. 9 is a partial fragmentary view illustrating a border to weft or warp member internal loop splice, with the weft or warp member passing through the border member.

Referring now to FIGS. 9 and 10, and more particularly to a further method of connecting weft and/or warf members to the border member 4, it should be seen that the border member 4 being a hollow braid member defines an internal elongate chamber 96 which is suitably sized to receive either the weft or warf members 6 and 8, respectively therein. In the illustrated example of FIG. 9, the member connecting to the border member 4 is a warf member 8. In this embodiment, the warf member 8 has a length that is sufficient to extend at least from the second border section 24, as best illustrated in FIG. 10 at securement point 36', along line A to the fourth border section 28 in such a manner as to pierce the fourth border section 28 at point 100 and thereafter be turned internally 90 degrees within the chamber 96 of the fourth border section 28 of the border member and be threaded towards point 102 a distance equal to the dimension S1 where it is caused to exit the border member in the illustrated manner. As such, for purposes of this discussion, the member 8 will be referred to as a continuous warp member. The returning length of the weft member as illustrated by numeral 8', extends parallel back in the direction AA whereupon it intersects the second border section 24 at point 104 as illustrated in FIG. 10, and is turned 90 degrees within the hollow confine 96 of the second border section 24 and again continues on in a downward manner for a length equal to the dimension S1 whereupon the internally disposed warf member 8" is caused to pierce the border member 4 from within the confine 96 and continue in the illustrated direction of A of FIG. 9, until a successive number of warp members necessary to complete the lattice are connected to the border member 4. In the embodiments of FIGS. 9 and 10, the warp member 8 takes the form of a continuous length of cord which is received within the internal confines of the border member 4 as it is caused to form the constituent members of the net lattice. It should nevertheless be understood that while the weft member is being so connected in this manner to the border member 4, it is also caused to be crossed with each of the weft members 6(*a*)–6(*f*) in the manner discussed above with respect to FIG. 2 as the length of the member 8 is caused to move in directions A and AA between the second border section 24 and the fourth border section 28. Also, as illustrated, the second free end of the continuous warp member 8 is ultimately secured to the border member 4 at a point like that shown at 36' and in a manner similar to that discussed with reference to the splice shown in FIGS. 3 and 5.

By the foregoing, and improved hollow braid net has been disclosed by way of the illustrated embodiment. However, numerous modifications and substitutions may be had without departing from the spirit of the invention. For example, while the hollow braid cordage disclosed in the present invention is shown absent any supplemental strands which can be disposed within the internal confine 96 of the hollow braid, it is nevertheless possible to practice the invention with a inserted elongate material which is provided to supplement the strength of the braid but which supplemental material is of a diameter thin enough to allow passage of the crossing weft and warf members in the manner disclosed above.

Accordingly, the invention has been described by way of illustration rather than limitation.

I claim:

1. A method of making a net comprising the steps of:

providing a border member defined by at least a first border section and a second border section each extending generally orthogonally to one another;

providing a plurality of weft members and connecting each of said weft members to one of said first and second border sections so as to dispose them in a first given direction;

providing a plurality of warp members and connecting each of said warp members to the other of said first and second border sections so as to dispose them in a second given direction;

crossing said weft and warp members with one another so as to lock the members against relative axial and twisting movement; and providing each of said weft and warp members as a hollow braid member capable of being transversely pierced by the other such members; and said weft and warp members crossing each other such that each of said weft member pierces the longitudinal extent of a warp member at points along the length of said warp member and each such weft member is caused to turn 180 degrees on itself after exhibiting said warp member and thereafter repierce said warp member transversely of its length so as to define laterally offset crossing points through said warp member each disposed in a single common plane of the net.

2. A method as defined in claim 1 further characterizing by providing said border member as a hollow braid member such that the connection between said weft and warp members and each of the first and second border sections is effected by piercing through the border member transversely of its length.

3. A method is defined in claim 2 further characterized by providing said border member as an enclosing member defined by first, second, third and fourth border sections with each successively ordered border section being disposed generally orthogonally to the next.

4. A method as defined in claim 3 further characterized by crossing said weft members and said warp members to form a plurality of boxes defining a lattice structure with each of said weft members being equidistantly spaced from the other and each of said warp members being equidistantly spaced from the other.

5. A method as defined in claim 4 further characterized by said step of crossing weft and warp members further including crossing a said plurality of weft members in progression with a single warp member starting from said one of said first and second border sections.

6. A method as defined in claim 3 further characterized by providing said border member with first and second free end portions forming an enclosing structure by splicing said first and second free end portions together with one another.

7. A method as defined in claim 6 further characterized by causing said border member first and second free end portions to collapse and assume a generally planar configuration in the region where each is spliced to the other.

8. A method as defined in claim 7 further characterized by forming said splice between said first and second end portions of said border by overlapping said first and second border end portions with one another and causing one of said warp or said weft members to pierce the overlap portions through and to return pierce through the overlap sections and thereafter pierce the involved one of the weft or warp member which is caused to interconnect the overlapped first and second end portions of the border member.

9. A method as defined in claim 3 further characterized in that said border member is an enclosing member defined by first and second end portions which are end spliced with one another by a serpentine connection whereby said first and second end portions respectively cross through each other and are subsequently caused to pierce the other and be tucked within the border end portion in which it was crossed.

10. A method as defined in claim 3 further characterized by each of said weft and warp members being connected to said border member by piercing said border member transversely of its length and thereafter turning 180 degrees and return piercing through the border member at a point laterally offset from the initial piercing point and thereafter be turned again 180 degrees so as to return pierce into the border member.

11. A method as defined in claim 10 further characterized by the free end of the piercing weft or warp member being tucked within the hollow confine of the border member.

12. A method as defined in claim 3 further characterized in that each of said weft and warp members connect with the border member by piercing the border member transversely of its length and thereafter turning 180 degrees after exiting the border member and then repiercing the border member at a point offset from the initial piercing point and thereafter pierce the involved weft or warp member at a point along its length which is adjacent the border member and thereafter be turned 180 degrees on itself and be caused to repierce the length of weft or warp member at a point laterally offset from the first piercing point.

13. A method as defined in claim 12 further characterized in that said repiercing of said involved weft or warp member along the same length thereof involves the free end of said weft or warp member being tucked within the hollow confine of the involved member.

14. A method as defined in claim 3 further characterized in that said warp member is comprised of a continuous length of cord which pierces the border member at points along said border defined by the lattice structure of the net; and said warp member is received within the hollow confines of said border member and extends along length thereof a given distance corresponding to the spacings of said lattice structure and thereafter is caused to exit the border member and be redirected in a direction opposite that in which the warp member entered the border member.

15. A method as defined in claim 1 further characterized by providing said weft and warp members as polypropylene rope having a multifilament construction.

16. A method as defined in claim 1 further characterized by providing said weft and warp members as polyester rope having a multifilament construction.

17. A net comprising:

a border member defined by at least a first border section and a second border section each extending generally orthogonally to one another;

a plurality of weft members each connected to one of said first and second border sections and being disposed in a first given direction;

a plurality of warp members each connected to the other of said first and second border sections and being disposed in a second given direction generally oriented orthogonally to the first given direction;

said weft and warp members being crossed with one another in a single common plane and in a manner which causes the members to be locked against relative axial and twisting movement; and providing each of said weft and warp members as hollow braid members capable of being transversely pierced by the other such member: and crossing each of said weft and warp members such that each of said weft member pierces the longitudinal extent of a warp member at points along the length of said warp member and each such weft member is caused to turn 180 degrees on itself after exiting said warp member and thereafter and repierce said warp member transversely of its length so as to define laterally offset crossing points through said warp member each disposed in a single common plane of the net.

18. A net is defined in claim 17 further characterized by providing said border member as an enclosing member defined by first, second, third and fourth border sections with each successively ordered border section being disposed generally orthogonally to the next.

19. A net as defined in claim 18 further characterized in that said border member is an enclosing member defined by first and second end portions which are end spliced with one another by a serpentine connection whereby said first and second end portions respectively cross through each other and are subsequently caused to pierce the other and be tucked within the border end portion in which it was crossed.

20. A net as defined in claim 18 further characterized by said border being defined by first and second end portions which are end spliced with one another, said splice between said first and second end portions of said border being accomplished by overlapping said first and second border end portions with one another and causing one of said warp or said weft members to pierce the overlap portions through and to return pierce through the overlap sections and thereafter pierce the involved one of the weft or warp member which is caused to interconnect the overlapped first and second end portions of the border member.

21. A net as defined in claim 17 further characterized by said weft and warp members being formed from a polypropylene having a multifilament construction.

22. A net as defined in claim 17 further characterized by said weft and warp members being formed from a polyester having a multifilament construction.

23. A method of making a net comprising the steps of:

providing a border member defined by at least a first border section and a second border section each extending generally orthogonally to one another;

providing a plurality of weft members and connecting each of said weft members to one of said first and second border sections so as to dispose them in a first given direction;

providing a plurality of warp members and connecting each of said warp members to the other of said first and second border sections so as to dispose them in a second given direction;

crossing said weft and warp members with one another so as to lock the members against relative axial and twisting movement; and providing each of said weft and warp members as a hollow braid member capable of being transversely pierced by the other such members;

said border member having first and second free end portions forming an enclosing structure by splicing said first and second free end portions together with one another; and forming said splice between said first and second end portions of said border by overlapping said first and second border end portions with one another and causing one of said warp or said weft members to pierce the overlap portions through and to return pierce through the overlap sections and thereafter pierce the involved one of the weft or warp member which is caused to interconnect the overlapped first and second end portions of the border member.

* * * * *

UNITED STATES PATENT AND TRADEMARK OFFICE

CERTIFICATE OF CORRECTION

PATENT NO. : 5,622,094

DATED : 4/22/97

INVENTOR(S) : John Rexroad

It is certified that error appears in the above-identified patent and that said Letters Patent is hereby corrected as shown below:

IN THE CLAIMS:

In column 8, line 35, delete "exhibiting" and replace with --exiting--.
(Claim 1)

Signed and Sealed this

Eighth Day of July, 1997

Bruce Lehman

*Attest:*

BRUCE LEHMAN

*Attesting Officer*

*Commissioner of Patents and Trademarks*